US008042925B2

(12) United States Patent
Sugahara et al.

(10) Patent No.: US 8,042,925 B2
(45) Date of Patent: Oct. 25, 2011

(54) INK CARTRIDGES

(75) Inventors: Hiroto Sugahara, Aichi-ken (JP); Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 833 days.

(21) Appl. No.: 11/959,404

(22) Filed: Dec. 18, 2007

(65) Prior Publication Data

US 2008/0180499 A1 Jul. 31, 2008

(30) Foreign Application Priority Data

Jan. 30, 2007 (JP) ..... 2007-018806

(51) Int. Cl.
*B41J 2/175* (2006.01)

(52) U.S. Cl. ..... 347/86

(58) Field of Classification Search ..... 347/85, 347/86, 87
See application file for complete search history.

(56) References Cited

U.S. PATENT DOCUMENTS

| | | | | |
|---|---|---|---|---|
| 5,453,772 | A * | 9/1995 | Aono et al. | 347/87 |
| 6,190,010 | B1 | 2/2001 | Tanaka | |
| 6,464,339 | B1 | 10/2002 | Ardito | |
| 6,513,919 | B2 * | 2/2003 | Shyn et al. | 347/86 |
| 6,540,341 | B2 * | 4/2003 | Hsieh et al. | 347/86 |
| 6,554,411 | B1 | 4/2003 | Hatasa et al. | |
| 6,830,324 | B2 * | 12/2004 | Ogura et al. | 347/86 |
| 6,899,418 | B2 * | 5/2005 | Sasaki et al. | 347/86 |
| 7,121,655 | B2 | 10/2006 | Silverbrook | |
| 7,188,939 | B1 | 3/2007 | Sasaki | |
| 7,192,128 | B1 | 3/2007 | Hattori et al. | |
| 7,350,909 | B2 | 4/2008 | Takagi et al. | |
| 7,416,290 | B2 * | 8/2008 | Hattori et al. | 347/86 |
| 7,416,291 | B1 * | 8/2008 | Hattori et al. | 347/86 |
| 7,419,254 | B1 * | 9/2008 | Hattori et al. | 347/86 |
| 7,470,012 | B2 * | 12/2008 | Kojima et al. | 347/86 |
| 2001/0030675 | A1 | 10/2001 | Kobayashi et al. | |
| 2002/0044184 | A1 | 4/2002 | Kobayashi et al. | |
| 2002/0063759 | A1 | 5/2002 | Hirano et al. | |
| 2003/0107629 | A1 | 6/2003 | Kobayashi et al. | |
| 2004/0085415 | A1 | 5/2004 | Kobayashi et al. | |
| 2004/0196341 | A1 | 10/2004 | Ogura et al. | |

(Continued)

FOREIGN PATENT DOCUMENTS

| | | | |
|---|---|---|---|
| CN | 1663801 | A | 9/2005 |

(Continued)

OTHER PUBLICATIONS

European Patent Office, European Search Report for Related EP Application No. 08003702 dated Jun. 10, 2008.

(Continued)

*Primary Examiner* — Anh T. N. Vo
(74) *Attorney, Agent, or Firm* — Baker Botts L.L.P.

(57) ABSTRACT

An ink cartridge includes a case, an ink supply portion positioned at a front face of the case, a movable member configured to move relative to the case, and at least one resilient member coupled to a rear face of the case and the movable member. The at least one resilient member is configured to expand in an expansion direction and to contract in a contraction direction to move the movable member relative to the case, and a shape of the case in the expansion and contraction directions is unaltered. The entire moveable member is configured to substantially simultaneously move relative to the case when the at least one resilient member expands and contracts.

16 Claims, 15 Drawing Sheets

U.S. PATENT DOCUMENTS

| | | | | |
|---|---|---|---|---|
| 2005/0168540 | A1 | 8/2005 | Wilson et al. | |
| 2006/0087532 | A1 | 4/2006 | Takata et al. | |
| 2006/0203051 | A1 | 9/2006 | Kanbe | |
| 2006/0221153 | A1 | 10/2006 | Kojima et al. | |
| 2007/0070140 | A1 | 3/2007 | Hattori et al. | |
| 2007/0070146 | A1* | 3/2007 | Hattori et al. | 347/86 |
| 2007/0126818 | A1 | 6/2007 | Hibbard et al. | |
| 2007/0139495 | A1 | 6/2007 | Hattori et al. | |
| 2007/0229615 | A1 | 10/2007 | Hattori et al. | |
| 2007/0242114 | A1 | 10/2007 | Kubota et al. | |

FOREIGN PATENT DOCUMENTS

| | | | |
|---|---|---|---|
| DE | 20316502 | U1 | 2/2004 |
| EP | 0237787 | A2 | 9/1987 |
| EP | 1792737 | A2 | 7/1999 |
| EP | 1190861 | A1 | 3/2002 |
| EP | 1300247 | A2 | 4/2003 |
| EP | 1769922 | A1 | 4/2007 |
| EP | 1772270 | A2 | 4/2007 |
| EP | 1886821 | A2 | 2/2008 |
| JP | S62-231760 | A | 10/1987 |
| JP | H07-060980 | A | 3/1995 |
| JP | H10-157162 | A | 6/1998 |
| JP | H11-005311 | A | 1/1999 |
| JP | 2000-006435 | A | 1/2000 |
| JP | 2001-071522 | A | 3/2001 |
| JP | 2003-237098 | A | 8/2003 |
| JP | 2004-209863 | A | 7/2004 |
| JP | 2004-299411 | A | 10/2004 |
| JP | 2004314602 | A | 11/2004 |
| JP | 2006159707 | A | 6/2006 |
| JP | 2007196653 | A | 8/2007 |

OTHER PUBLICATIONS

European Patent Office, Partial European Search Report for Related EP Application No. 08003713 dated Jun. 13, 2008.

European Patent Office, European Search Report for Related EP Application No. 08003695 dated May 29, 2008.

International Search Report (International Patent Application No. PCT/JP2008/056271—counterpart to above-captioned patent application), mailed May 1, 2008.

The State Intellectual Property Office of the People's Republic of China; Notification of First Office Action in Chinese Patent Application No. 20810004453.6 (counterpart to the above-captioned U.S. patent application) mailed Oct. 9, 2009.

The State Intellectual Property Office of the People's Republic of China; Notification of First Office Action in Chinese Patent Application No. 200810087258.4 (counterpart to the above-captioned U.S. patent application) mailed Dec. 18, 2009.

European Patent Office, Partial European Search Report for Related EP Application No. 08003713 dated Jul. 3, 2008.

Intellectual Property Office of Singapore, Search Report and Written Opinion for Singapore Patent Application No. 200905481-8 (counterpart to above-captioned patent application), dated Dec. 15, 2010.

Japan Patent Office, Notice of Reasons for Rejection for Japanese Patent Application No. 2007-018806 (counterpart to above-captioned patent application), mailed Jun. 14, 2011.

* cited by examiner

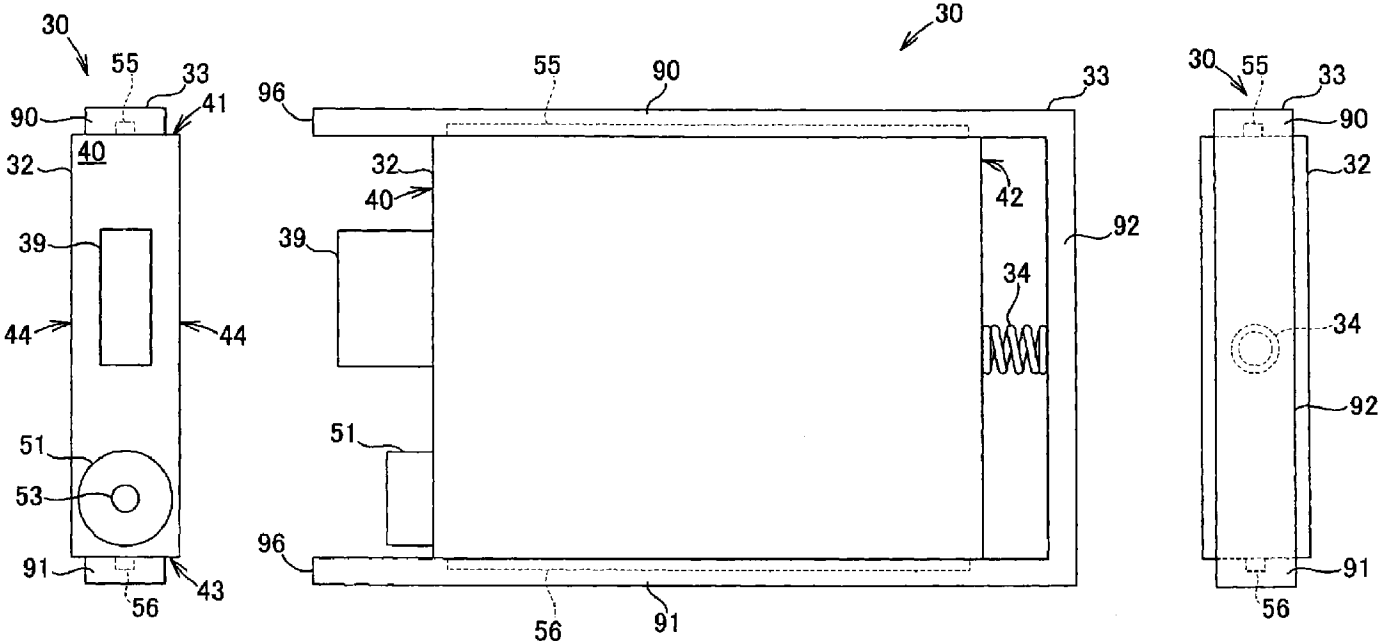
FIG.2(a)
FIG.2(b)
FIG.2(c)
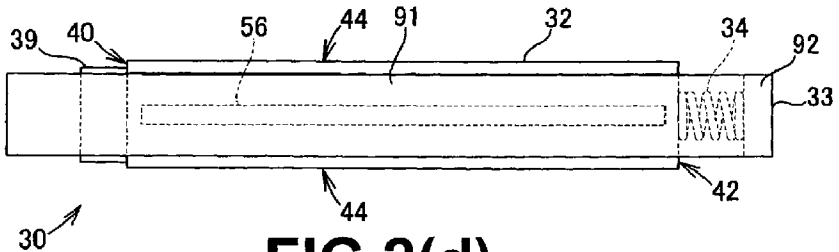
FIG.2(d)

INK CARTRIDGES

CROSS-REFERENCE TO RELATED APPLICATION

The present invention claims priority from Japanese Patent Application No. JP-2007-018806, which was filed on Jan. 30, 2007, the disclosure of which is incorporated herein by reference in its entirety.

BACKGROUND OF THE INVENTION

1. Field of the Invention

The present invention relates generally to ink cartridges. In particular, the present invention is related to ink cartridges which are configured to dispense ink when mounted in a printer.

2. Description of Related Art

A known ink cartridge is configured to be mounted to a mounting portion of a known recording apparatus, such as an ink-jet recording apparatus. The known ink cartridge has an ink chamber configured to store ink therein, a wall defining at least a portion of the ink chamber, and an ink supply portion positioned at the wall, which is configured to supply ink from the interior of the ink chamber to the exterior of the ink chamber. The ink supply portion extends outwardly from the wall. A resilient member is disposed within the ink supply portion. When the known ink cartridge contacts a surface, such as a floor, a portion of the impact of the ink cartridge contacting the surface may be absorbed by the resilient member.

Nevertheless, because the resilient member is disposed within the ink supply portion, an outer portion of the ink supply portion may be damaged when the ink supply portion contacts the surface, which may cause ink to leak from the ink supply portion. Moreover, if the ink cartridge contacts the surface at a position other than the ink supply portion, the ink cartridge may be damaged, and ink may leak from the ink cartridge.

Another known ink cartridge is configured to be mounted to an accommodating chamber of the known recording apparatus, and the accommodating chamber includes a door which is configured to be opened and closed. After the known ink cartridge is mounted to the accommodating chamber and the door is closed, the door may latch on to the ink cartridge to remove the ink cartridge from the accommodating chamber when the door is opened by a user, which increases the ease with which the ink cartridge may be removed from the accommodating chamber. Nevertheless, the user relies on the recording apparatus to remove the ink cartridge from the recording apparatus.

SUMMARY OF THE INVENTION

Therefore, a need has arisen for ink cartridges which overcome these and other shortcomings of the related art. A technical advantage of the present invention is that the ink cartridge may be protected from damage when the ink cartridge contacts the surface. Another technical advantage of the present invention is that the ink cartridge readily may be removed from the recording apparatus.

According to an embodiment of the present invention, an ink cartridge comprises a case, an ink supply portion, a movable member, and at least one resilient member. The case has at least a portion of an ink chamber defined therein, and the ink chamber is configured to store ink. Moreover, the case has a front face and a rear face opposite the front face. The ink supply portion is positioned at the front face of the case, and the ink supply portion is configured to dispense ink from an interior of the ink chamber to an exterior of the ink chamber. The movable member is configured to move relative to the case. The at least one resilient member has a first end which is coupled to the rear of the case, and a second end which is coupled to the movable member. Moreover, the at least one resilient member is configured to expand in an expansion direction and to contract in a contraction direction opposite the expansion direction to move the movable member relative to the case, and a shape of the case in the expansion and contraction directions is unaltered when the at least one resilient member expands and contracts. The entire moveable member is configured to substantially simultaneously move in a first direction relative to the case when the at least one resilient member expands, and the entire moveable member is configured to substantially simultaneously move in a second direction opposite the first direction when the at least one resilient member contracts.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

FIGS. 2(*a*)-2(*d*) are a front view, a side view, a rear view, and a bottom view, respectively, of an ink cartridge according to an embodiment of the present invention.

FIG. 3(*b*) is a cross-sectional view of the case taken along the line IIIb-IIIb of FIG. 3(*a*).

FIG. 5(*b*) is another schematic depicting the ink cartridge of FIGS. 2(*a*)-2(*d*) when contacting a surface, in which the third plate portion of the movable member faces downward.

FIG. 6(*b*) is another schematic depicting the ink cartridge of FIGS. 2(*a*)-2(*d*) when contacting a surface, in which a front face of the case faces downward.

DETAILED DESCRIPTION OF EMBODIMENTS

Embodiments of the present invention and their features and technical advantages may be understood by referring to FIGS. 1-15, like numerals being used for like corresponding portions in the various drawings.

Figure 1:
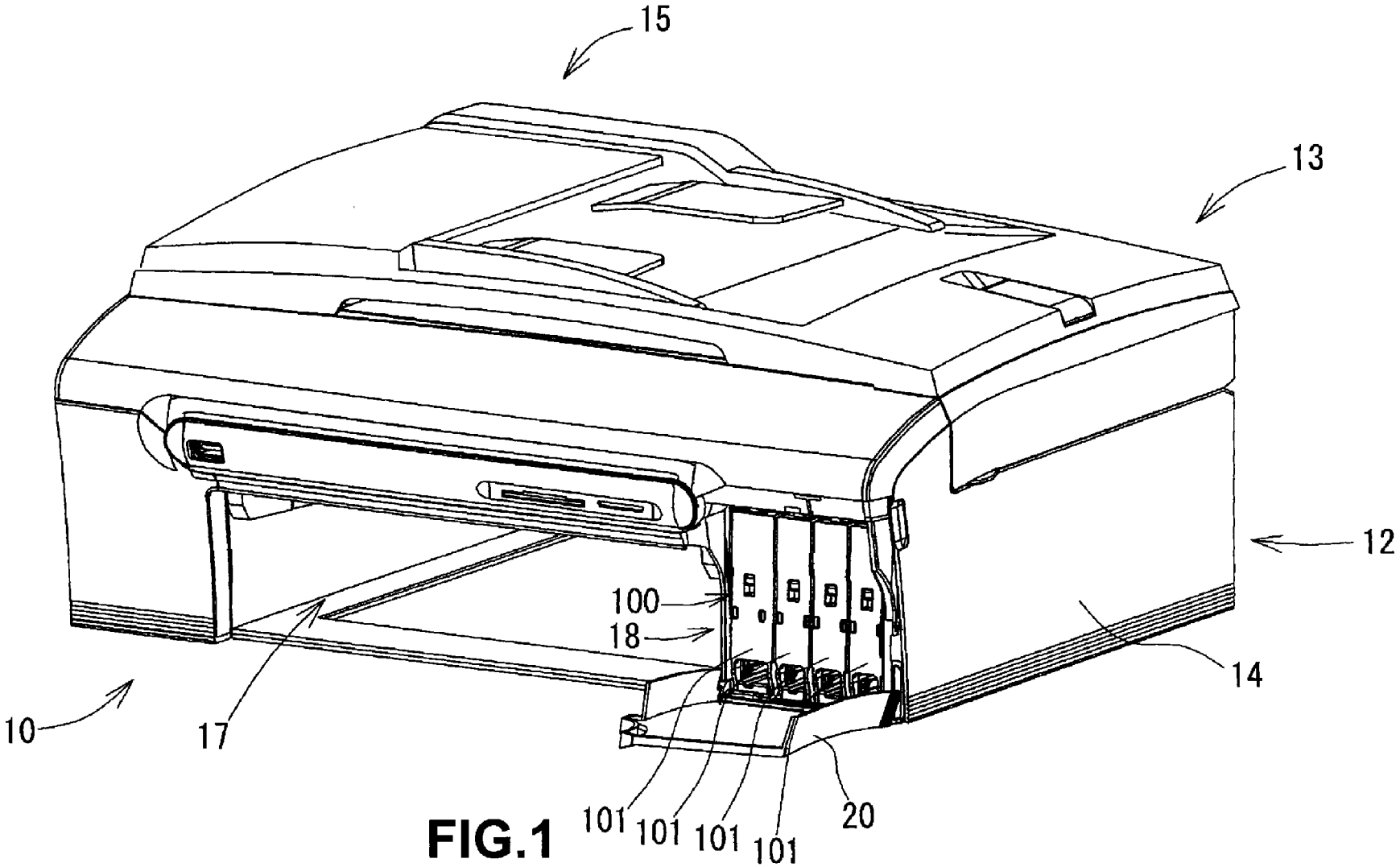
FIG. 1 is a perspective view of a multi-function device, according to an embodiment of the present invention.

Referring to FIG. 1 a multi-function device 10 configured to be used with an ink cartridge 30 according to an embodiment of the invention is depicted. Multi-function device 10 may comprise a printer portion 12 at the bottom and a scanner portion 13 at the top. Scanner portion 13 may comprise an automatic sheet feeder 15. Multi-function device 10 is configured to be connected to a computer or another external device, e.g., a digital camera. When printing data is transmitted to printer portion 12 from the computer, the external device, or scanner portion 13, printer portion 12 prints an image on a sheet of paper based on the printing data.

Multi-function device 10 may have a substantially rectangular parallelepiped shape having a width, a depth, and a height. Each of the width and the depth may be greater than the height. Printer portion 12 may comprise a case 14, and case 14 may have an opening 17 formed therethrough at a center of a front face of case 14. A tray (not shown) configured to accommodate sheets of paper may be disposed in case 14, and the tray is configured to be removed from the interior of case 14 through opening 17. Case 14 also may have an opening 18 formed therethrough at a position adjacent to an end of the front face of case 14 in the width direction of multi-function device 10. Multi-functional device 10 also may comprise a cartridge accommodating portion 100 positioned in case 14, and cartridge accommodating portion 100 is exposed to the exterior of case 14 through opening 18. Cartridge accommodating portion 100 may comprise a plurality of, e.g., four, cartridge accommodating cases 101, each of which may be configured to accommodate an ink cartridge 30 therein. Each ink cartridge 30 may store ink therein, e.g., each ink cartridge 30 may store a different color of ink therein. For example, a first ink cartridge 30 may store black ink therein, a second ink cartridge 30 may store yellow ink therein, a third ink cartridge 30 may store cyan ink therein, and a fourth ink cartridge may store magenta ink therein. The plurality of cartridge accommodating cases 101 may be aligned in the width direction of multi-function device 10.

Multi-function device 10 may comprise a door 20, and the lower end of door 20 is coupled to case 14 below opening 18, such that door 20 is configured to pivot about the lower end of door 20. Door 20 is configured to expose cartridge accommodating portion 100 through opening 18 when door 20 is opened, and to cover opening 18 when door 20 is closed.

Figure 3A:
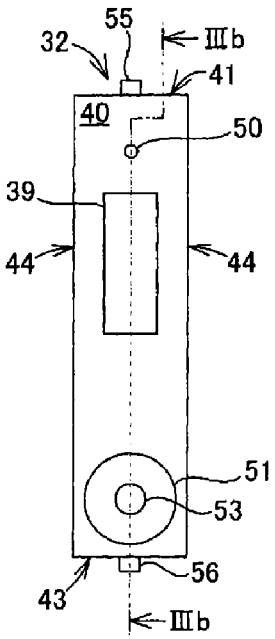
FIG. 3(*a*) is a front view of a case of the ink cartridge of FIGS. 2(*a*)-2(*d*).
Figure 3B:
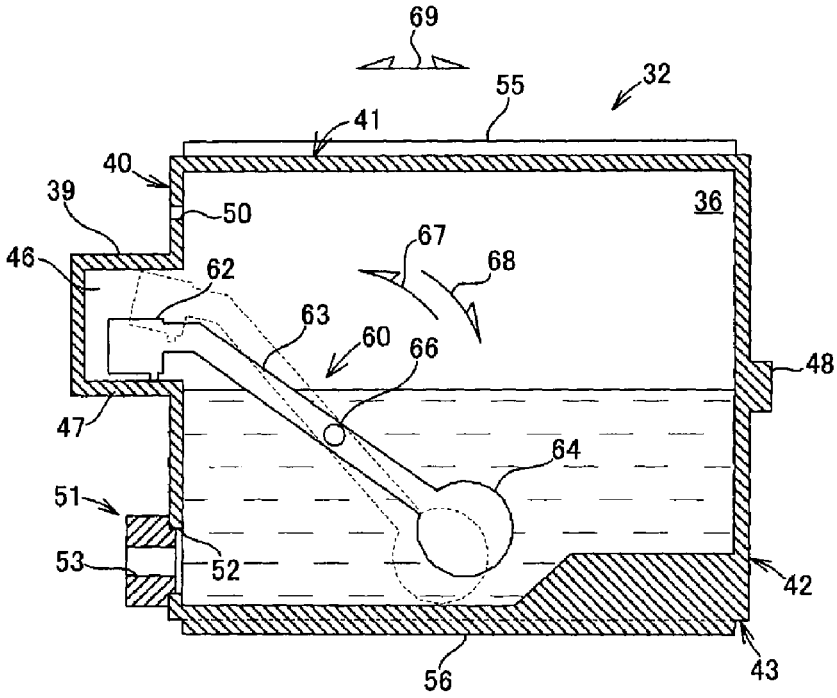
Figure 4:
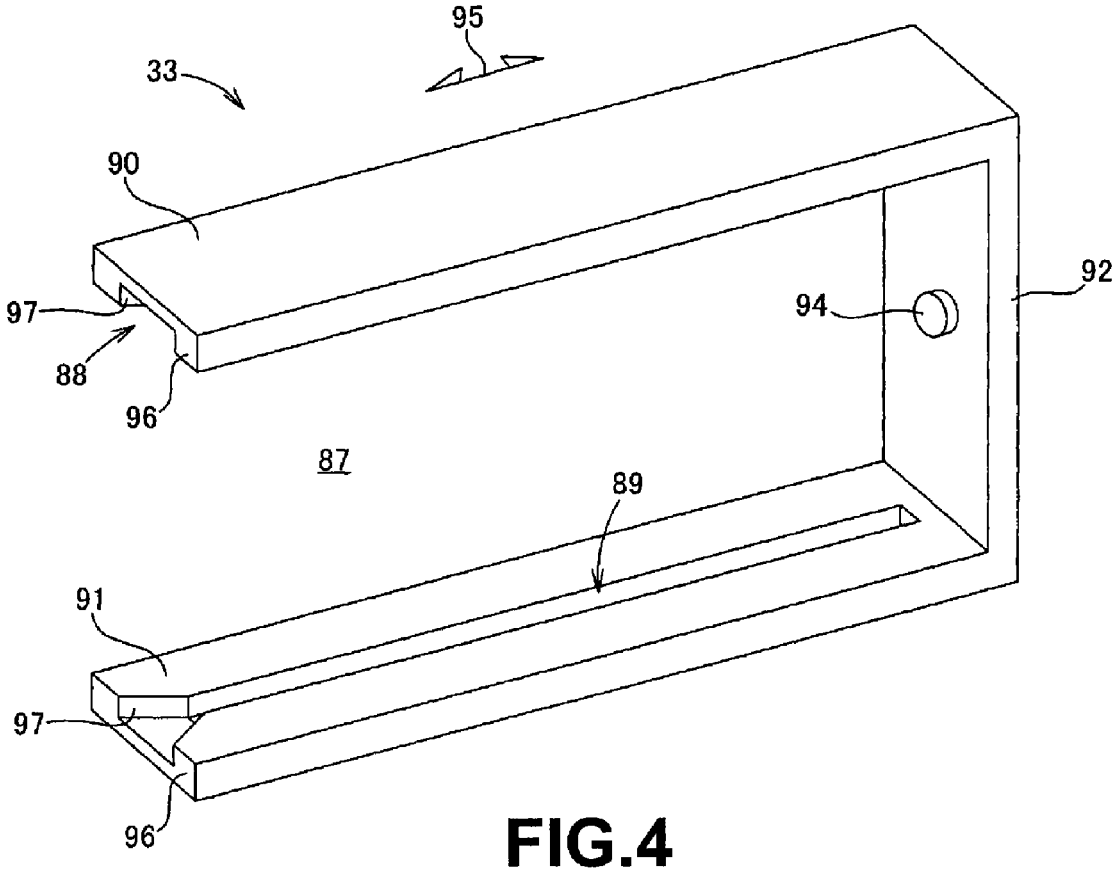
FIG. 4 is a perspective view of a movable member of the ink cartridge of FIGS. 2(*a*)-2(*d*).

Referring to FIGS. 2-4, ink cartridge 30 may comprise a case 32, a movable member 33, and a resilient member, e.g., a coil spring 34. Case 32 and movable member 33 may be coupled via coil spring 34, and movable member 33 may be configured to move relative to case 32, e.g., to slide on case 32, when coil spring 34 expands in an expansion direction and contracts in a contraction direction which is opposite the expansion direction. For example, a first end of coil spring 34 may be coupled to case 32, and a second end of coil spring 34 may be coupled to movable member 33. Coil spring 34 may be coupled to case 32 by direct contact or by indirect contact therebetween, and coil spring may be coupled to movable member 32 by direct contact or by indirect contact therebetween. When coil spring 34 is indirectly connected to case 32, at least one element is positioned between coil spring 34 and case 32. Similarly, when coil spring 34 is indirectly connected to movable member 33, at least one element is positioned between coil spring 34 and movable member 33.

Case 32 may have a substantially rectangular parallelepiped shape having a front face 40, a rear face 42 opposite front face 40, a top face 41, a bottom face 43 opposite top face 41, and side faces 44 opposite each other. Each of top face 41 and bottom face 43 is connected to front face 40 and rear face 42, and each of side faces 44 is connected to front face 40, rear face 42, top face 41, and bottom face 43. Each of front face 40, top face 41, rear face 42, bottom face 43, and side faces 44 may be substantially parallel to its opposing face, and substantially perpendicular to the other faces. Case 32 has a width form one of side faces 44 to the other of side faces 44, a depth from front face 40 to rear face 42, and a height from top face 41 to bottom face 43. The height of case 32 may be greater than the width of case 32, and the depth of case 32 may be greater than the height of case 32. Case 32 may comprise an ink chamber 36 formed therein, and ink chamber 36 is configured to store ink. Case 32 may comprise at least one translucent resin material, e.g., a transparent resin material or a semi-transparent resin material, which allows light to pass therethrough.

In an embodiment, a shape of case 32 in the expansion and contraction directions may not be altered when coil spring 34 expands and contracts. The entire moveable member 33 may be configured to substantially simultaneously move in a first direction relative to case 32 when coil spring 34 member expands, and the entire moveable member 33 may be configured to substantially simultaneously move relative to case 32 in a second direction opposite the first direction when coil spring 34 contracts.

Case 32 may comprise a translucent portion 39, and rails 55 and 56 at top face 41 and bottom face 43, respectively. A pivotable member 60 may be pivotally disposed within ink chamber 36. Translucent portion 39 may be positioned at front face 40 and may extend away from ink chamber 36. The translucent portion 39 may be integral with case 32, and may comprise the same material as frame 32. Translucent portion 39 may be irradiated with light emitted from a sensor 103 of multi-function device 10.

In an embodiment, those portions of case 32 other than translucent portion 39 may be covered with an opaque member to avoid the deterioration of ink disposed in ink chamber 36 due to exposure to ultraviolet radiation. In any of the above-described embodiments, case 32 may comprise a frame which comprises front face 40, top face 41, rear face 42, and bottom face 43, and each of side faces 44 may comprise a film connected to, e.g., adhered to, the frame, such as by welding.

Translucent portion 39 may project outward from a center portion of front face 40 of case 32 in a direction away from ink chamber 36. Translucent portion 39 may be defined by five rectangular walls and may have an inner space 46 formed therein which has a substantially a hollow box shape. For example, translucent portion 39 may be defined by a front wall, a pair of side walls, a top wall, and a bottom wall 47. The front wall may extend parallel to front face 40 and may be separated from front face 40 by a predetermined distance. The pair of side walls may be connected to front face 40 and the front wall, the top wall may be connected to the top ends of the front wall and the side walls, and bottom wall 47 may be connected to bottom ends of the front wall and the side walls. Moreover, the width of the front wall may be less than the width of front face 40.

Inner space 46 of translucent portion 39 may be configured to be in fluid communication with ink chamber 36, e.g., there may be no wall positioned between inner space 46 and ink chamber 36. An indicating portion 62 of the pivotable member 60 is configured to move within inner space 46, e.g., between a first position and a second position within inner space 46. For example, when indicating portion 62 is at the first position, indicating portion 62 may contact bottom wall 47 of translucent portion 39, as indicated by a solid line in FIG. 3(*b*), and when indicating portion 62 is positioned at the second position, indicating portion 62 may be separated form bottom wall 47 of translucent portion 39, as indicated by a dotted line in FIG. 3(*b*).

Pivotable member 60 may be used to determine whether the amount of ink stored in the ink chamber 36 is greater than or equal to a sufficient amount of ink. Pivotable member 60 may comprise indicating portion 62 at one end thereof, and a float portion 64 at the other end thereof. Pivotable member 60 also may comprise a shaft 66 which is connected to indicating portion 62 and float portion 64. Shaft 66 extends in the width direction of case 32, and shaft 66 may be supported by supporting portions disposed on inner surfaces of walls defining side faces 44, respectively, such that pivotable member 60 pivots about shaft 66 in directions indicated by arrows 67 and 68 in FIG. 3(*b*).

The specific gravity of float portion 64 may be less than the specific gravity of ink stored in the ink chamber 36. Float portion 64 may have a hollow formed therein, and floats on liquid, such that the float portion 64 moves upward and downward based on the amount of ink within the ink chamber 36, and pivotable member 60 pivots based on the movement of float portion 64. Alternatively, float portion 64 may be a solid element comprising a material having a specific gravity less than the specific gravity of ink.

Indicating portion 62 may be configured to indicate whether the amount of ink in the ink chamber 36 is greater than or equal to a sufficient amount of ink. When pivotable member 60 pivots counterclockwise in FIG. 3(*b*), indicating portion 62 contacts bottom wall 47 of translucent portion 39, such that further movement of pivotable member 60 is prevented and indicating portion 62 remains at the first position. When pivotable member 60 pivots clockwise in FIG. 3(*b*), indicating portion 62 moves away from bottom wall 47 of the translucent portion 39. When float portion 64 contacts a bottom surface of the ink chamber 36, further movement of pivotable member 60 is prevented, and indicating portion 62 remains at the second position apart from bottom wall 47 of translucent portion 39 by a predetermined distance.

Pivotable member 60 may comprise a first portion extending from shaft 66 to indicating portion 62, and a second portion extending from shaft 66 to float portion 64. The mass of the first portion of pivotable member 60 may be less than the mass of the second portion of pivotable member 60. Therefore, the second portion of pivotable member 60 may be heavier than the first portion of pivotable member 60 in the air. Accordingly, when the ink chamber 36 does not store a sufficient amount of ink therein, pivotable member 60 pivots clockwise about shaft 66 in FIG. 3(*b*), and indicating portion 62 separates from bottom wall 47 of detecting window 39. When the lower end of float portion 64 contacts the bottom surface of ink chamber 36, pivotable member 60 stops pivoting and the indicating portion 62 remains at the second position. When indicator portion 62 is at the second position, it is determined that the amount of ink in ink chamber 36 is less than a sufficient amount of ink.

In contrast, when the amount of ink in ink chamber 36 is greater than or equal to a sufficient amount of ink, and float portion 64 is submerged in the ink, a buoyancy force acts on float portion 64. The buoyancy force causes the pivotable member 60 to pivot counterclockwise about shaft 66 in FIG. 3(*b*). When pivotable member 60 pivots counterclockwise, indicating portion 62 contacts bottom wall 47 of translucent portion 39, and pivotable member 60 stops pivoting and indicating portion 62 remains at the first position. When indicating portion 62 is at the first position, it may be determined that the amount of ink in ink chamber 36 is greater than or equal to a sufficient amount of ink.

Specifically, whether the amount of ink in ink chamber 36 is greater than or equal to the predetermined amount of ink may be determined based on the position of indicating portion 62 in the inner space 46, e.g., the position of indicating portion 62 may be detected by a photo interrupter or viewed by a user.

Front face 40 may have an opening 52 formed therethrough adjacent to an end of front face 40 connected to bottom face 43, and the interior of ink chamber 36 may be configured to be in fluid communication with the exterior of case 32 via opening 52. Ink cartridge 30 may comprise an ink supply portion 51 positioned at front face 40 of case 32 adjacent to the end of front face 40 connected to bottom face 43. Ink supply portion 51 may comprise a cylindrical rubber member having an inner hole 53 formed therethrough. The cylindrical rubber member may comprise a first portion and a second portion. The first portion of the cylindrical rubber member may be press fitted in opening 52, and the second portion of the cylindrical rubber member extends outward from front face 40. Opening 52 and inner hole 53 are aligned, such that the interior of ink chamber 36 is configured to be in fluid communication with the exterior of case 32 via opening 52 and inner hole 53. A film (not shown) may be positioned on an end of the cylindrical rubber member to cover inner hole 53. When ink cartridge 30 is installed in cartridge accommodating case 101, a connecting portion 111 may be connected to ink supply portion 51, such that a needle (not shown) of connecting portion 111 penetrates through the film and enters inner hole 53. Ink then may be supplied from ink chamber 36 to a recording head (not shown) of multi-function device 10 via ink supply portion 51 and connecting portion 111.

An air intake hole 50 may be formed through front face 40, and the interior of ink chamber 36 may be configured to be in fluid communication with the exterior of case 32 via air intake hole 50. Before ink cartridge 30 is used, a sticker (not shown) may cover the air intake hole 50, and the sticker prevents fluid communication between the interior of the ink chamber 36 and the exterior of case 32 via air intake hole 50. When a user intends to use ink cartridge 30, the user removes the sticker, and thereby ink chamber 36 is brought into fluid communication with the exterior of case 32 via air intake hole 50.

Case 32 may comprise a spring seat 48 formed on and extending outwardly from rear face 42 at a middle portion of rear face 42 in the height direction of case 32. An end of coil spring 34 may be connected and fixed to spring seat 48.

Rail 55 extends outwardly from top face 41 and extends from a portion adjacent to front face 40 to a portion adjacent to rear face 42 in the depth direction of case 32. The depth direction of case 32 is indicated by an arrow 69 in FIG. 3(*b*). Rail 56 extends outwardly from bottom face 43 and extends from a portion adjacent to front face 40 to a portion adjacent to rear face 42 in the depth direction of case 32.

Referring to FIGS. 2 and 4, movable member 33 may be configured to support case 32, such that movable member 33 moves relative to case 32, e.g., slides on case 32 when coil spring 34 expands and contracts. Movable member 33 may comprise a first plate portion 90, a second plate portion 91 opposite first plate portion 90, and a third plate portion 92 connected to first plate portion 90 and second plate portion 91. First plate portion 90 and second plate portion 91 may be parallel to each other, and third plate portion 92 may be perpendicular to each of first plate portion 90 and second plate portion 91. Each of first plate portion 90 and second plate portion 91 has a first end 96 and a second end opposite first end 96, and third plate portion 92 has a first end and a second end opposite the first end. The first end of third plate potion 92 may be connected to the second end of first plate portion 90, and the second end of third plate portion 92 may be connected to the second end of the second plate portion 91. Case 32 may be surrounded by first plate portion 90, second plate portion 91, and third plate portion 92. First plate portion 90 may face top face 41, second plate portion 91 may face bottom face 43, and third plate portion 92 may face rear face 42.

First plate potion 90 may have a first groove 88 formed in the surface facing top face 41, and first groove 88 extends from first end 96 of first plate portion 90 towards the second end of first plate portion 90. First plate portion 90 may engage top face 41, e.g., first groove 88 may extend parallel to rail 55, and rail 55 may be positioned within first groove 88. Second plate potion 91 may have a second groove 89 formed in the surface facing bottom face 43, and second groove 89 extends from first end 96 of second plate portion 91 towards the second end of second plate portion 91. Second plate portion 91 may engage bottom face 43, e.g., second groove 89 may extend parallel to rail 56, and rail 56 may be positioned within second groove 89. Each of first groove 88 and second groove 89 may have a wide portion 97 adjacent to first end 96, and the width of wide portion 97 may increase as wide portion 97 approaches first end 96. During the manufacture of ink cartridge 30, rails 55 and 56 readily may slide in first groove 88 and second groove 89 with the aid of wide portions 97.

Third plate portion 92 may comprise a spring seat 94 formed on and extending outwardly from the surface facing rear face 42 at a middle portion of third plate portion 92 in the height direction of case 32. An end of coil spring 34 may be connected and fixed to spring seat 94.

Each of first plate portion 90 and second plate portion 91 may extend adjacent to and away from front face 40 in the second direction in which translucent portion 39 and ink supply portion 51 extends outwardly from front face 40. Each of first plate portion 90 and second plate portion 91 may extend further outwardly from front face 40 than translucent portion 39 and ink supply portion 51 extends from front face 40 in the second direction, independent of whether coil spring 34 is in an expanded or contracted position.

In another embodiment, first plate portion 90 or second plate portion 91 may be omitted.

In an embodiment of the present invention, ink cartridge 30 may be manufactured, as follows. An end of coil spring 34 may be connected and fixed to spring seat 94 of third plate portion 94. Case 32 then may be inserted from rear face 42 side into a space 87 which is surrounded by first plate portion 90, second plate portion 91, and third plate portion 92. Rails 55 and 56 then may be inserted into first and second grooves 88 and 89, respectively, via wide portions 97. After that, the other end of coil spring 34 may be connected and fixed to spring seat 48 of case 32. The direction in which movable member 33 and case 32 slides relative to each other may be parallel to the direction in which coil spring 34 expands and contracts.

Figure 5B:
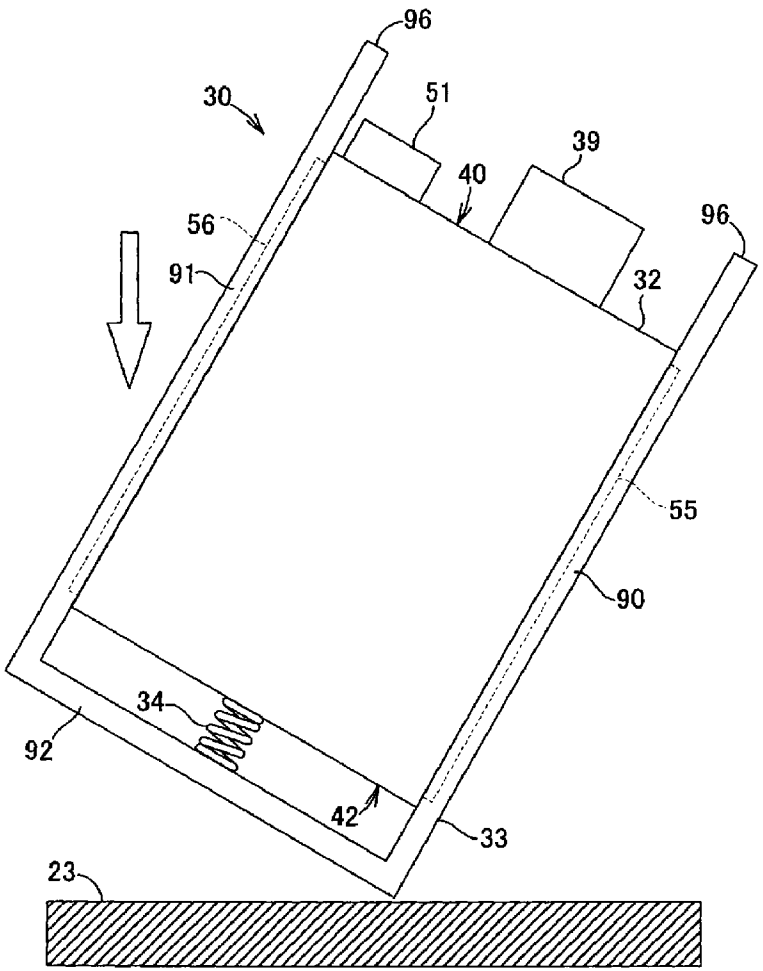
FIG. 5(*a*) is a schematic depicting the ink cartridge of FIGS. 2(*a*)-2(*d*) when contacting a surface, in which a third plate portion of the movable member faces downward.
Figure 5A:
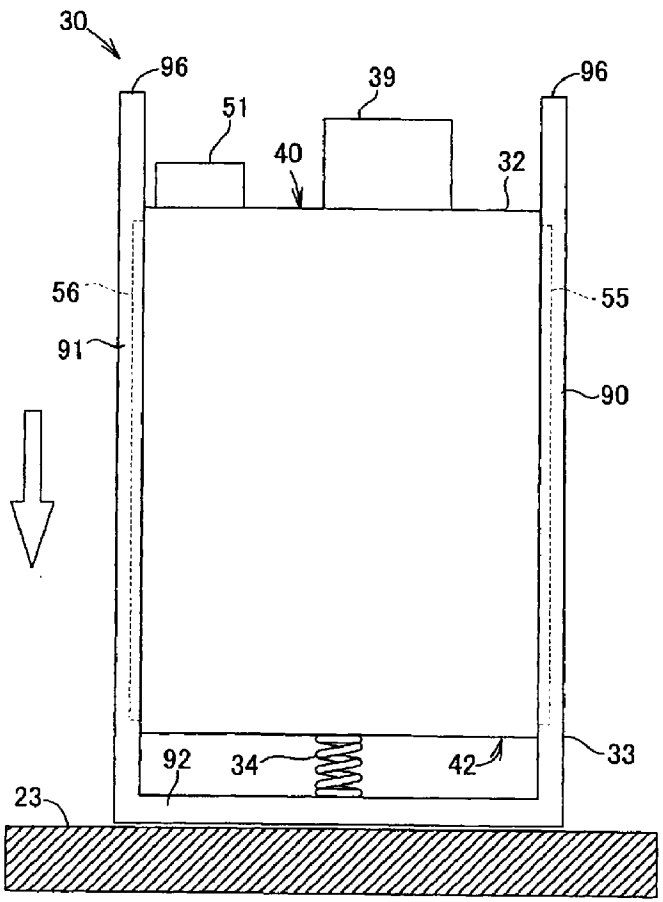

Referring to FIG. 5(*a*), when ink cartridge 30 contacts a surface 23 with third plate portion 92 facing downward, third plate portion 92 contacts the surface 23, and the impact of movable member 33 contacting surface 23 is at least partially absorbed by coil spring 34. Moreover, referring to FIG. 5(*b*), when the corner of first plate portion 90 and third plate portion 92 contacts surface 23, a component of the impact in the depth direction of case 32 is absorbed by coil spring 34. Consequently, case 32 is protected from the impact, and case 32 may not be damaged by the impact.

Moreover, when ink cartridge 30 is transferred, e.g., during shipment of ink cartridge 30 from a factory, ink cartridge 30 may vibrate. Nevertheless, the vibration may not be transferred to case 32 because coil spring 34 absorbs the vibration. Consequently, the vibration may not generate air bubbles in ink chamber 36.

Figure 6B:
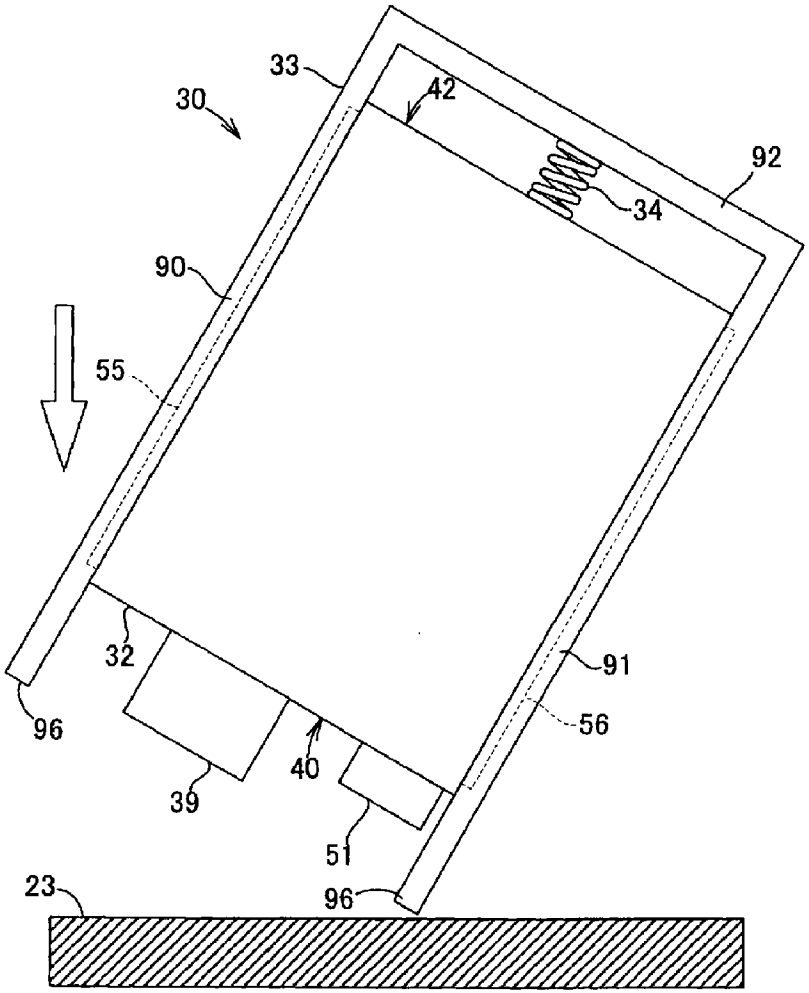
FIG. 6(*a*) is a schematic depicting the ink cartridge of FIGS. 2(*a*)-2(*d*) when contacting a surface, in which a front face of the case faces downward.
Figure 6A:
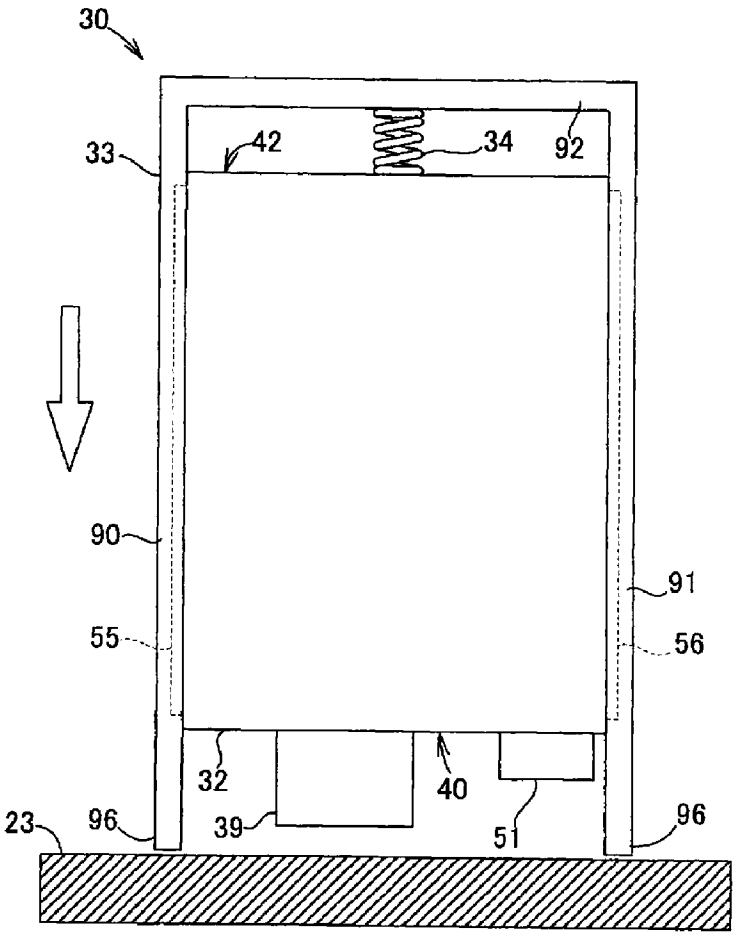

Referring to FIGS. 6(*a*) and 6(*b*), when ink cartridge 30 contacts surface 23 with front face 40 facing downward, either first end 96 of first plate portion 90 or first end 96 of second plate portion 91, or both, contacts the surface 23, and at least a portion of the impact of movable member 33 contacting surface 23 is absorbed by coil spring 34. Consequently, case 32 is protected from the impact, and case 32 may not be damaged by the impact. Moreover, because each of first plate portion 90 and second plate portion 91 extends further outwardly from front face 40 than translucent portion 39 and ink supply portion 51 extends from front face 40, ink supply portion 51 and translucent portion 39 do not contact surface 23. Consequently, the impact is not directly transferred to ink supply portion 51 or translucent portion 39, or both, which prevents ink supply portion 51 and translucent portion 39 from being damaged.

Figure 7:
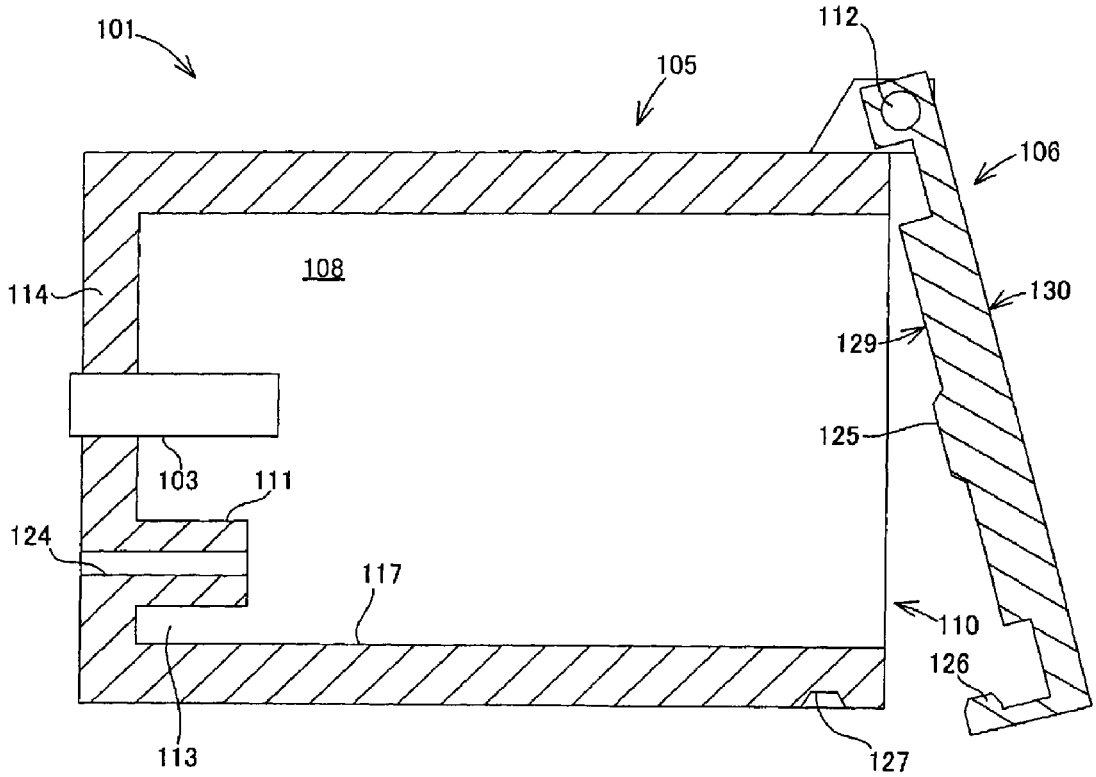
FIG. 7 is a cross-sectional view of a cartridge accommodating case, according to an embodiment of the present invention.

Referring to FIG. 7, cartridge accommodating case 101 may comprise a case main body 105 and a lock lever 106. Case main body 105 may comprise an accommodating chamber 108 formed therein. Case main body 105 may have an opening 110 formed therethrough, which may be positioned adjacent to opening 18 of case 14 of printer portion 12. Ink cartridge 30 may be selectively installed in and removed from accommodating chamber 108 via opening 110.

Case main body 105 may have a wall 114 defining an end of accommodating chamber 108 opposite from opening 110, and an optical sensor 103 may be provided at wall 114. Optical sensor 103 may be a photo interrupter comprising a light emitting portion and a light receiving portion. When ink cartridge 30 is installed in accommodating chamber 108, translucent portion 39 is positioned between the light emitting portion and the light receiving portion. Depending on the position of indicating portion 62 in translucent portion 39, the intensity of light received by the light receiving portion varies. Based on the intensity of light received by the light receiving portion, it is determined whether the amount of ink in ink cartridge 30 is greater than or equal to a sufficient amount of ink.

A connecting portion 111 may be provided at wall 114 below optical sensor 103. Connecting portion 111 extends from wall 144 towards the interior of accommodating chamber 108. When ink cartridge 30 is installed in accommodating chamber 108, connecting portion 111 is connected to ink supply portion 51, such that a needle (not shown) provided at connecting portion 111 penetrates through the film (not shown) of ink supply portion 51 and enters inner hole 53. Connecting portion 111 may have a through hole 124 formed therethrough, and one end of through hole 14 may be connected to the needle and the other end of through hole 14 may be connected to a flexible tube (not shown) which is connected to a recording head (not shown).

Case main body 105 may comprise a bottom wall 117, and a space 113 may be formed between bottom wall 117 and connecting portion 111. When ink cartridge 30 is installed in accommodating chamber 108, first end 96 of second plate portion 91 may be positioned within space 113.

The upper end of lock lever 106 may be coupled to case main body 105 above opening 110, such that lock lever 106 pivots about the upper end of lock lever 106. Lock lever 106 is configured to expose accommodating chamber 108 through opening 110 when lock lever 106 is opened, and to cover opening 110 when lock lever 106 is closed. Lock lever 106 may comprise a pressing portion 125 and a claw 126. Pressing portion 125 extends from a middle portion of an inner surface 129 of lock lever 106. Claw 126 may be positioned at the lower end of lock lever 106. Bottom wall 117 may have a cut-out 127 formed in the outer surface of bottom wall 117 below opening 110, and claw 126 may be configured to engage cut-out 127.

Figure 8:
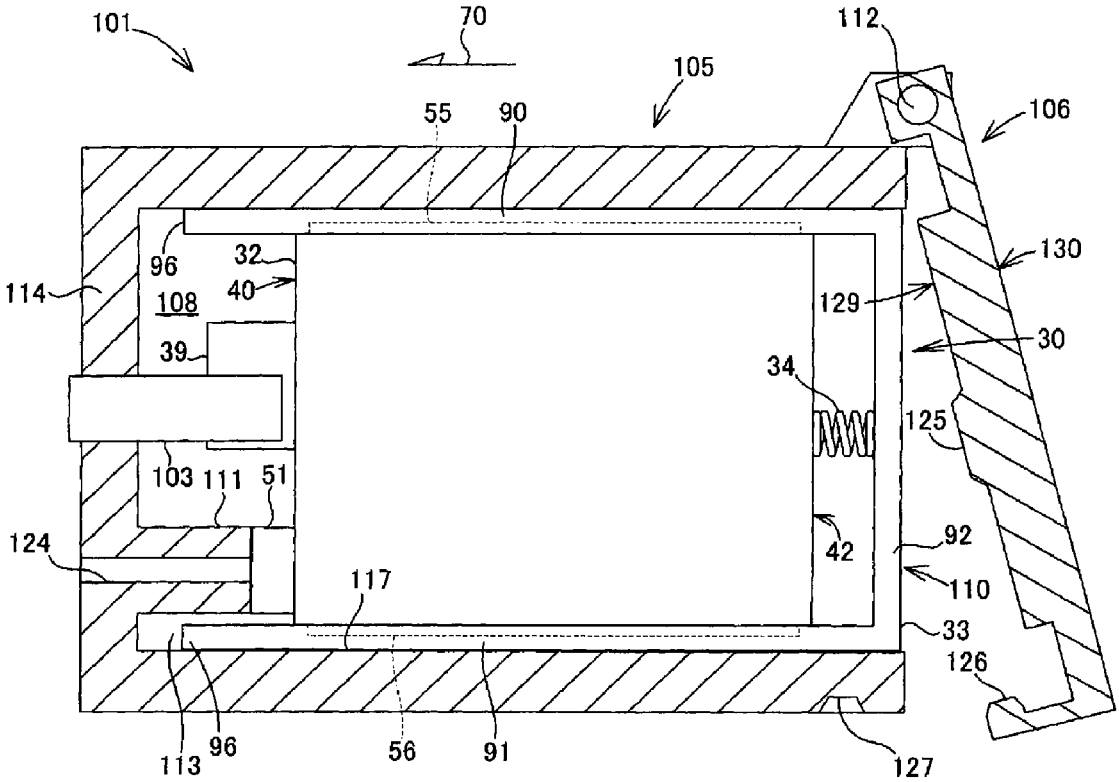
FIG. 8 is a cross-sectional view of the ink cartridge of FIGS. 2(*a*)-2(*d*) mounted to the cartridge accommodating case of FIG. 7, in which a lock lever is in an open position.
Figure 9:
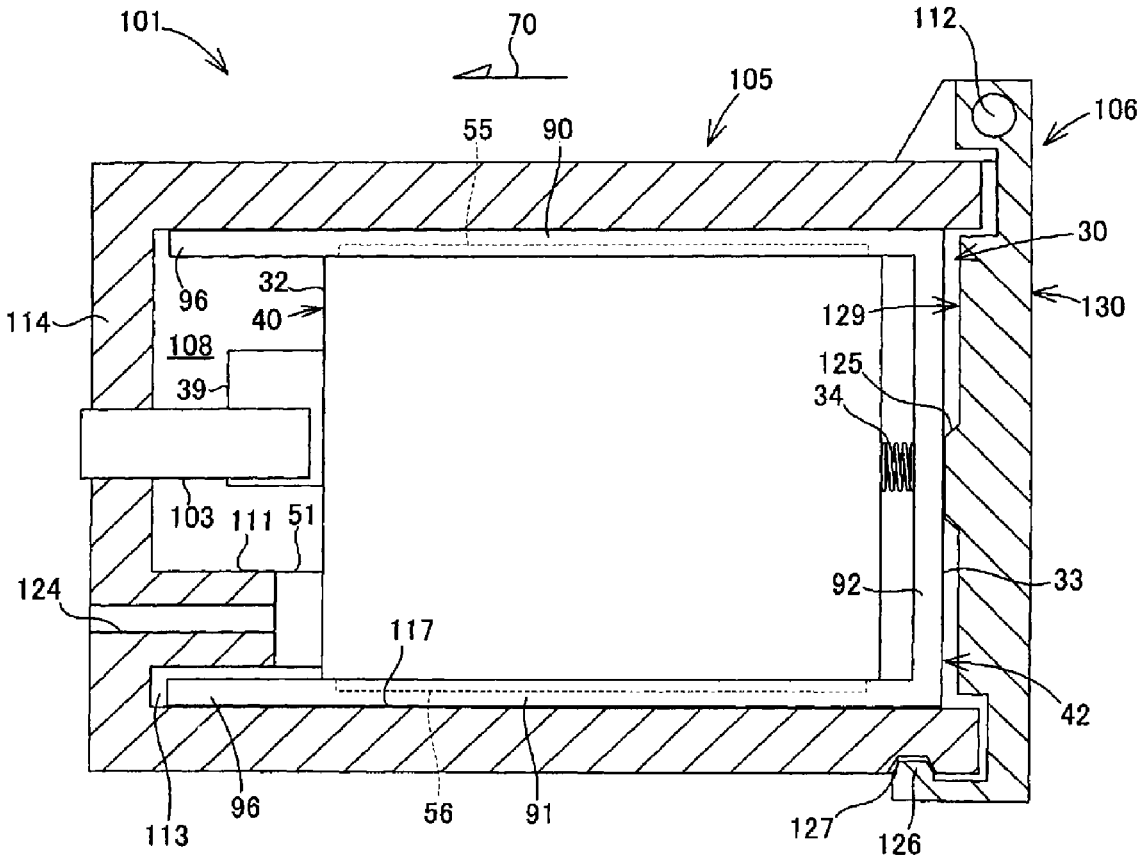
FIG. 9 is a cross-sectional view of the ink cartridge of FIGS. 2(*a*)-2(*d*) mounted to the cartridge accommodating case of FIG. 7, in which a lock lever is in a closed position.

Referring to FIGS. 8 and 9, the process of installing ink cartridge 30 in cartridge accommodating case 101 is described. Ink cartridge 30 may be inserted into accommodating chamber 108 until ink supply portion 51 contacts connecting portion 111, translucent portion 39 enters between the light emitting portion and the light receiving portion of optical sensor 103, and first end 96 of second plate portion 91 enters space 113.

Lock lever 106 then may be pivoted towards the case main body 105 until pressing portion 125 contacts third plate potion 92. When lock lever 106 pivots further, coil spring 34 may contract and movable member 33 may move towards wall 114, while case 32 may remain stationary. When lock lever 106 pivots further, claw 126 may engage cut-out 127, and lock lever 160 may be completely closed and may be fixed to case main body 105. Lock lever 106 may retain ink cartridge 30 in case main body 105 and ink supply portion 51 may be pressed against connecting portion 111 by coil spring 34.

With this configuration, ink cartage 30 may be installed in cartridge accommodating case 101 securely. Moreover, ink cartridge 30 may be pressed in an installation direction as indicated by an arrow 70 in FIGS. 8 and 9 with a constant force depending on the elasticity of coil spring 34. Furthermore, because ink supply portion 51 is pressed against connecting portion 111 tightly, ink may be prevented from leaking between ink supply portion 51 and connecting portion 111.

When a user intends to remove ink cartridge 30 from cartridge accommodating case 101, the user may disengage claw 126 from cut-out 127. Consequently, coil spring 34 may expand, which causes movable member 33 to push up lock lever 106 and causes ink cartridge 30 to be partially ejected from case main body 105. The user then may grasp the rear portion of movable member 33 and removes ink cartridge 30 from cartridge accommodating case 101. Thus, ink cartridge 30 readily may be removed from cartridge accommodating case 101.

Figure 10:
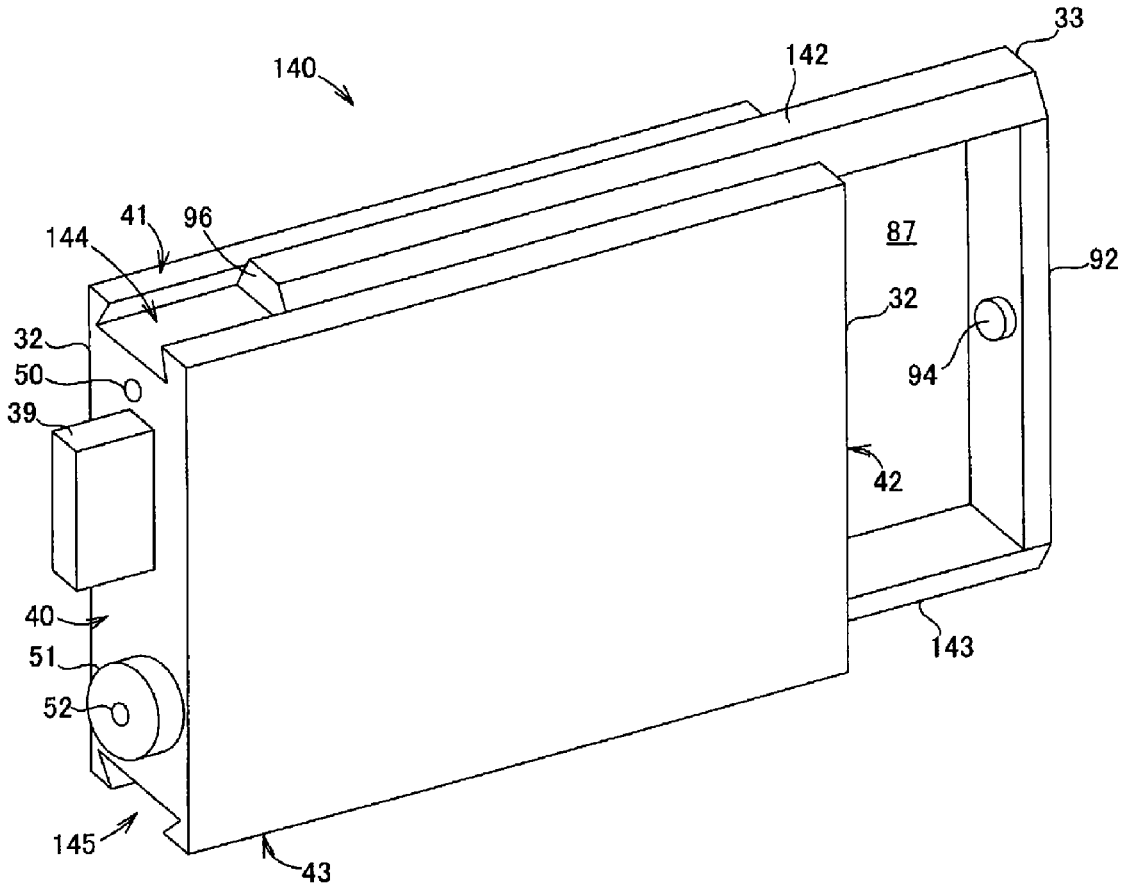
FIG. 10 is a perspective view of an ink cartridge, according to another embodiment of the present invention.

Referring to FIG. 10, an ink cartridge 140 according to another embodiment of the present invention is depicted. In this embodiment, movable member 33 may comprises a first plate portion 142 and a second plate portion 143 instead of first plate portion 90 and second plate portion 91. A cross-sectional shape of each of first plate portion 142 and second plate portion 143 may be trapezoidal. The upper base of the trapezoidal cross sectional-shape of first plate portion 142 may be shorter than the lower base of the trapezoidal cross-sectional shape of first plate portion 142. The upper base of the trapezoidal cross-sectional shape of second plate portion 143 may be longer than the lower base of the trapezoidal cross-sectional shape of second plate portion 143. Case 32 may not comprise rails 55 and 56, but may comprise a groove 144 and a groove 145 formed in top face 41 and bottom face 43, respectively. Groove 144 may extend from the corner of top face 41 and front face 40 to the corner of top face 41 and rear face 42 in the depth direction of case 32, and groove 145 may extend from the corner of bottom face 43 and front face 40 to the corner of bottom face 43 and rear face 42 in the depth direction of case 32. A cross-sectional shape of each of groove 144 and groove 145 may be trapezoidal. The upper base of the trapezoidal cross-sectional shape of groove 144 may be shorter than the lower base of the trapezoidal cross-sectional shape of groove 144. The upper base of the trapezoidal-cross sectional shape of groove 145 may be longer than the lower base of the trapezoidal-cross sectional shape of groove 145. First plate portion 142 and second plate portion 143 may be inserted into groove 144 and groove 145, respectively, such that first plate portion 142 and second plate portion 143 slides in groove 144 and groove 145, respectively. Because of the trapezoidal cross-sectional shape of first plate portion 142, second plate portion 143, groove 144, and groove 145, case 32 and movable member 30 may be coupled reliably, and ink cartridge 140 may be disassembled only when movable member 30 slides off case 32 in the depth direction of case 32.

Figure 11A:
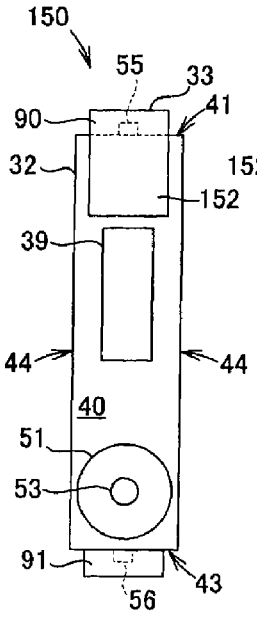
FIGS. 11(*a*) and 11(*b*) are a front view and a side view, respectively, of an ink cartridge, according to yet another embodiment of the present invention.
Figure 11B:
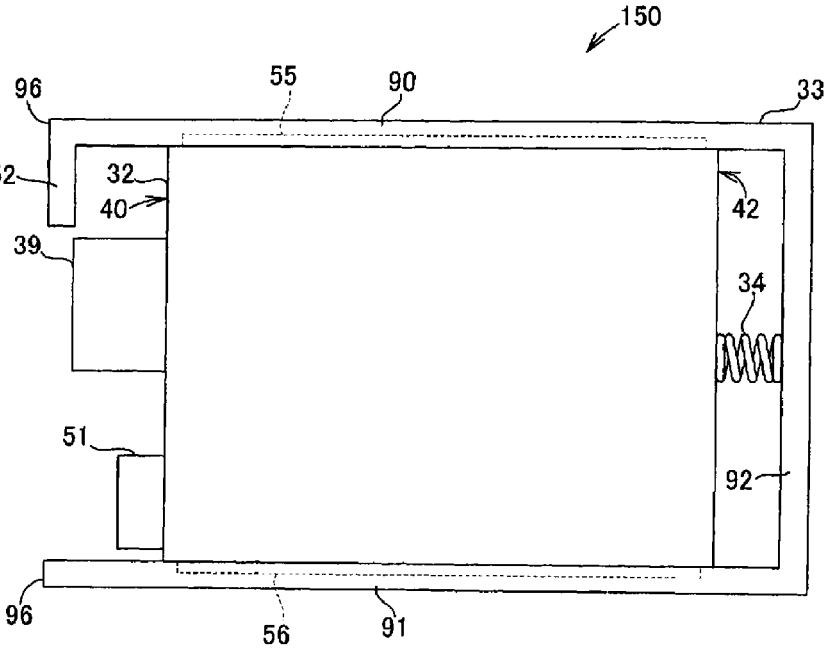

Referring to FIGS. 11(*a*) and 11(*b*), an ink cartridge 150 according to yet another embodiment of the present invention is depicted. In this embodiment, movable member 33 further comprises a fourth plate portion 152 extending from first end 96 of first plate portion 90 downwardly and substantially perpendicular to first plate portion 90. The lower end of fourth plate portion 152 is positioned above and adjacent to translucent portion 39. Fourth plate portion 152 may be manufactured separately from movable member 33, and may be attached to movable member 33 via ultrasonic welding.

When ink cartridge 150 contacts a surface with front face 40 facing downward, front face 40 may be protected by fourth plate portion 152. For example, when ink cartridge 150 contacts a surface with an amount of force greater than a predetermined amount of force, and coil spring 32 expands too much, the sliding motion of case 32 to the front face 40 side may be restricted by forth plate portion 152.

Figures 12A, 12B:
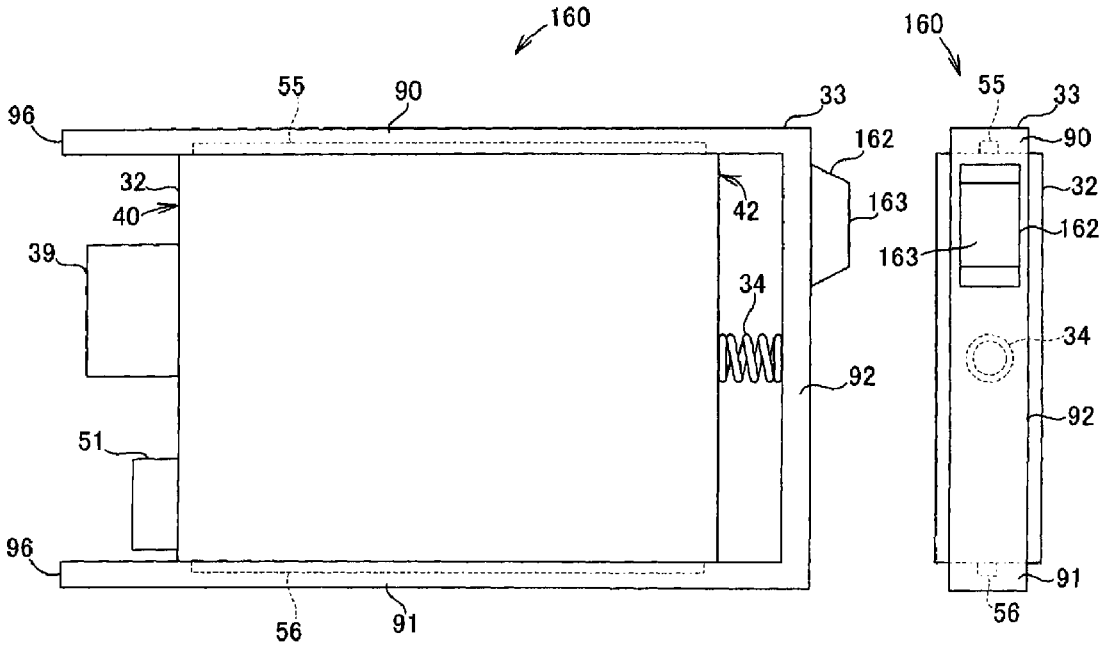
FIGS. 12(*a*) and 12(*b*) are a side view and a rear view, respectively, of an ink cartridge, according to still another embodiment of the present invention.

Referring to FIGS. 12(*a*)-15, an ink cartridge 160 according to still another embodiment of the present invention is depicted. In this embodiment, movable member 33 may further comprise a grasping portion 162 formed on and extending from the outer surface of third plate portion 92. Ink cartridge 160 may be configured to be installed in a cartridge accommodating case 165. When a user intends to install or remove ink cartridge 160 in or from cartridge accommodating case 165, the user may grasp grasping portion 162.

Figure 13B:
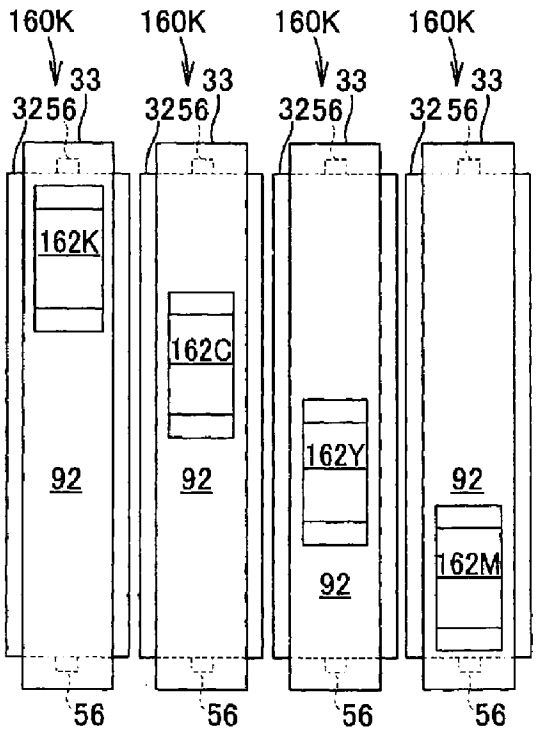
FIGS. 13(*a*) and 13(*b*) are a side view and a rear view, respectively, of the ink cartridges of FIGS. 12(*a*) and 12(*b*), in which four ink cartridges are positioned side by side.
Figure 13A:
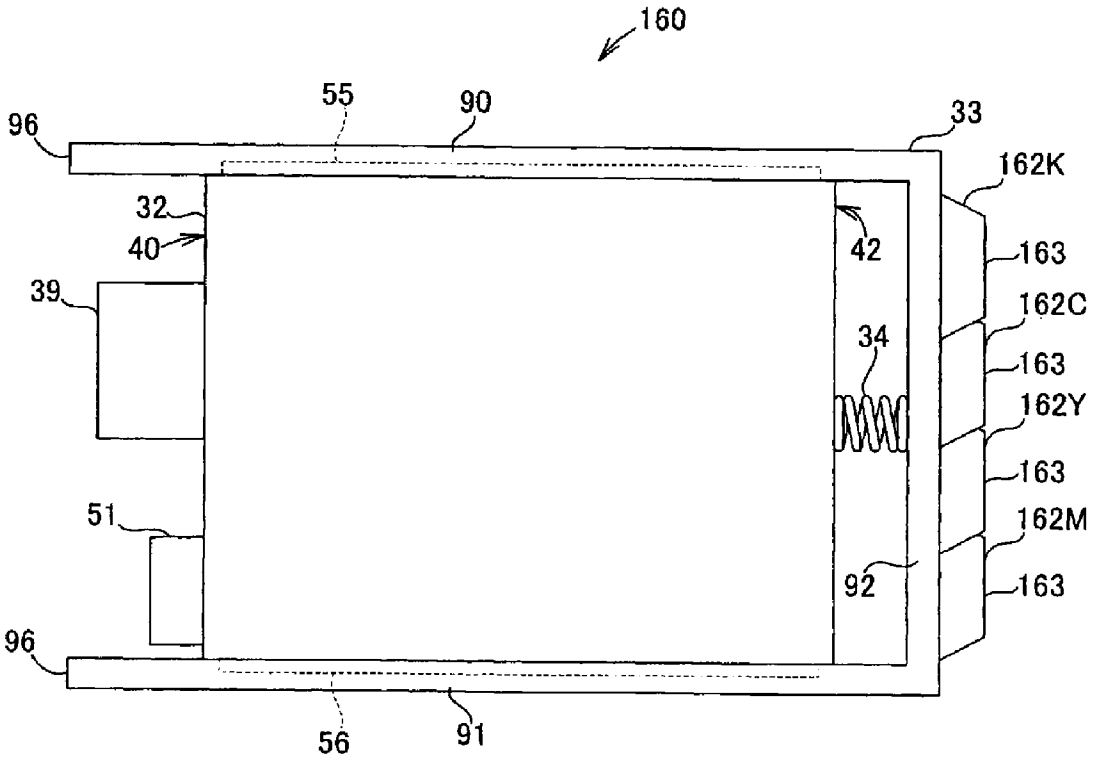

The position of grasping portion 162 may depend on the color of ink stored in ink cartridge 160. Referring to FIG. 13, a grasping portion 162K of an ink cartridge 160K storing black ink may be positioned adjacent to the upper end of third plate portion 92, a grasping portion 162C of an ink cartridge 160C storing cyan ink may be positioned below grasping portion 162K of ink cartridge 160K, a grasping portion 162Y of an ink cartridge 160Y storing yellow ink may be positioned below grasping portion 162C of ink cartridge 160C, and a grasping portion 162M of an ink cartridge 160M storing magenta ink may be positioned adjacent to the lower end of third plate portion 92 and below grasping portion 162Y of ink cartridge 160Y. When ink cartridges 160K, 160C, 160Y, and 162M are placed side by side, grasping portions 162K, 162C, 162Y, and 162M may be offset in the height direction of case 32. Therefore, a user readily may grasp grasping portions 162K, 162C, 162Y, and 162M without interference from adjacent grasping portions 162K, 162C, 162Y, and 162M.

Figure 14:
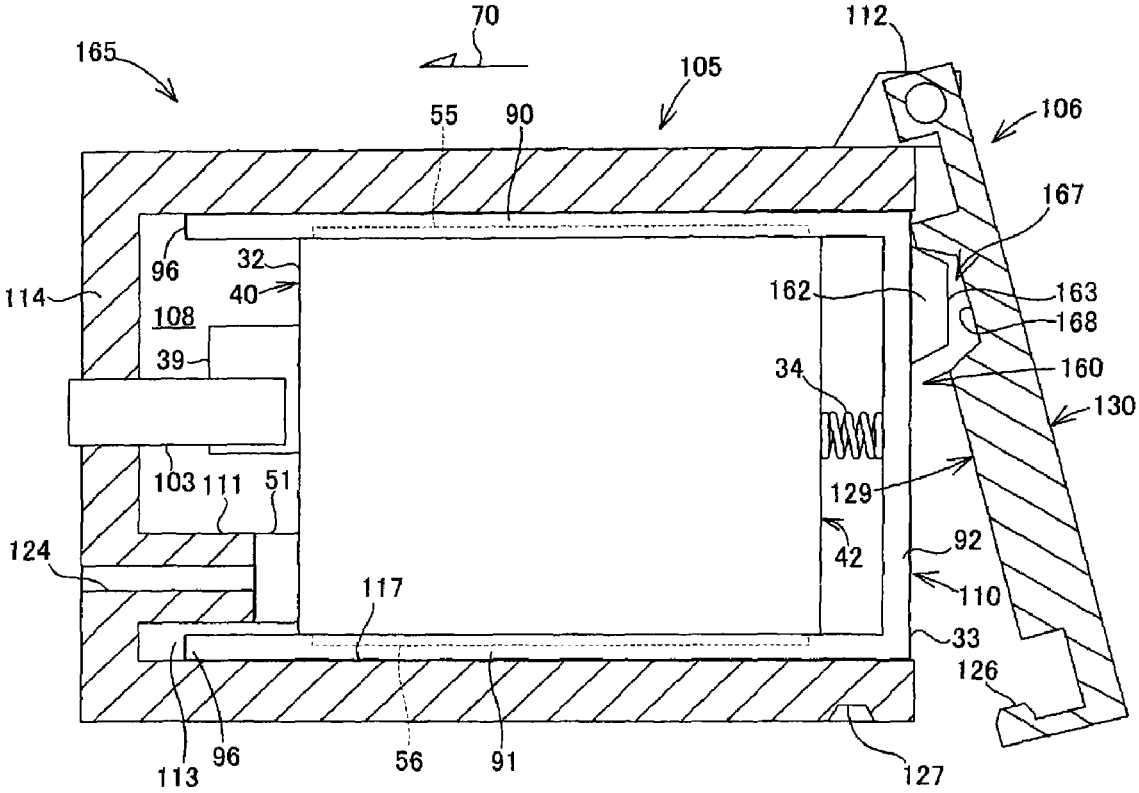
FIG. 14 is a cross-sectional view of the ink cartridge of FIGS. 12(*a*)-12(*b*) mounted to a cartridge accommodating case, in which a lock lever is in an open position.
Figure 15:
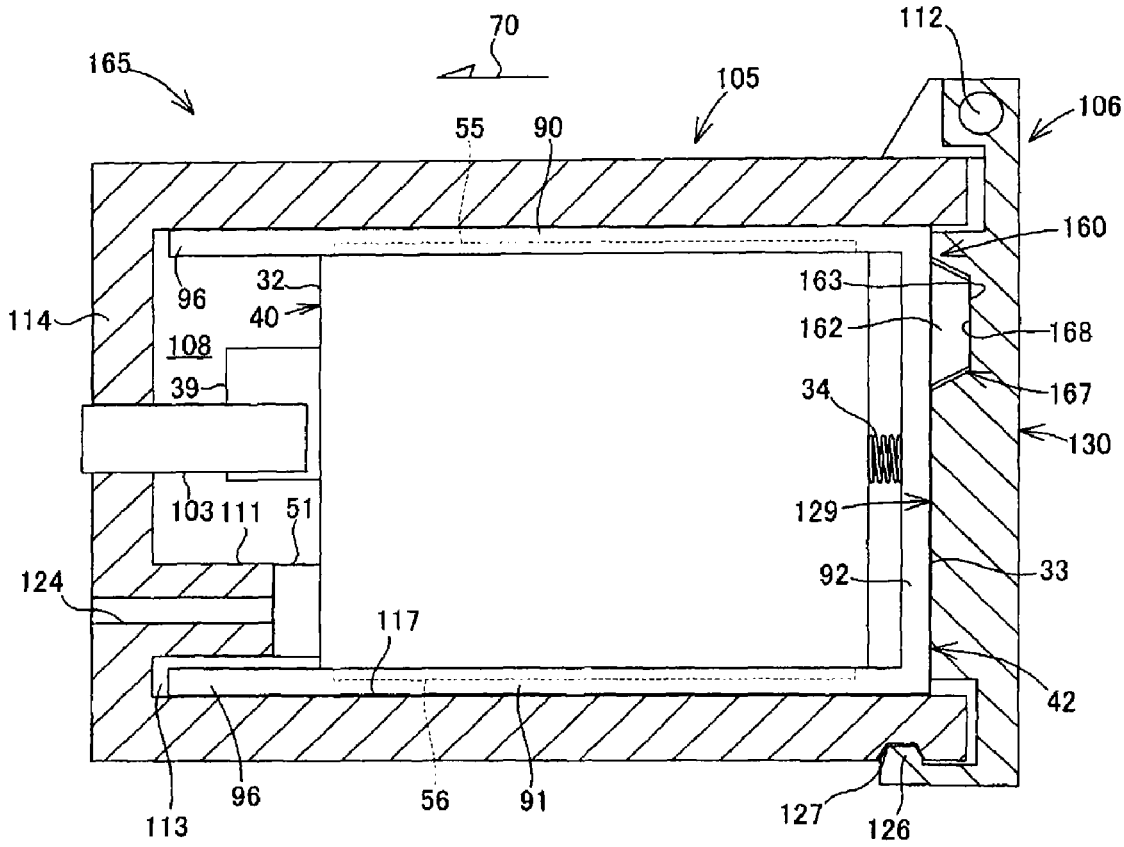
FIG. 15 is a cross-sectional view of the ink cartridge of FIGS. 12(*a*)-12(*b*) mounted to the cartridge accommodating case, in which a lock lever is in a closed position.

Referring to FIGS. 14 and 15, lock lever 106 may comprise a recess 167 formed in inner surface 129 of lock lever 106 instead of pressing portion 125. When ink cartridge 160 is installed in cartridge accommodating case 165, grasping portion 162 may be accommodated in recess 167. The shape and the position of recess 167 may correspond to the shape and the position of grasping portion 162. The position of recess 167 may depend on the color of ink which is stored in the installed ink cartridge 160.

Referring to FIGS. 14 and 15, the process of installing ink cartridge 160 in cartridge accommodating case 165 is described. Ink cartridge 160 may be inserted into accommodating chamber 108 until ink supply portion 51 contacts connecting portion 111.

Lock lever 106 then may be pivoted towards the case main body 105, grasping portion 162 may enter recess 167, and an end 163 of grasping portion 162 may contact a bottom 168 of recess 167. When lock lever 106 pivots further, coil spring 34 contracts and movable member 33 moves towards wall 114, and case 32 may remain stationary. When lock lever 160 pivots further, claw 126 may engage cut-out 127, and lock lever 160 may be completely closed and fixed to case main body 105.

Because the position of recess 167 depends on the color of ink which the installed ink cartridge 160 stores therein, if ink cartridge 160K is inadvertently installed in cartridge accommodating case 165 configured to accommodate ink cartridge 160C, recess 167 does not accommodate grasping portion 162K. Consequently, a user readily may notice that the user installed the ink cartridge in a wrong one of cartridge accommodating cases 165.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

The invention claimed is:

1. An ink cartridge, comprising:

a case having at least a portion of an ink chamber defined therein, wherein the ink chamber is configured to store ink, and the case comprises an inner surface and an outer surface, wherein the outer surface has a front face and a rear face opposite the front face, and the ink chamber is positioned between the front face and the rear face;

an ink supply portion positioned at the front face of the case, wherein the ink supply portion is configured to dispense ink from an interior of the ink chamber to an exterior of the ink chamber;

a movable member configured to move relative to the case; and at least one resilient member having a first end which is coupled to the rear face of the case and a second end which is coupled to the movable member, wherein the at least one resilient member is configured to expand in an expansion direction and to contract in a contraction direction opposite the expansion direction to move the movable member relative to the case, and a size of the case in the expansion and contraction directions is unaltered when the at least one resilient member expands and contracts, wherein the entire moveable member is configured to substantially simultaneously move in a first direction relative to the case when the at least one resilient member expands, and the entire moveable member is configured to substantially simultaneously move in a second direction opposite the first direction when the at least one resilient member contracts.

2. The ink cartridge of claim 1, further comprising an air intake portion positioned at the case, wherein the air intake portion is configured to draw air into the ink chamber.

3. The ink cartridge of claim 2, wherein the air intake portion is positioned at the front face of the case.

4. The ink cartridge of claim 1, wherein the at least one portion of the movable member extends adjacent to and away from the front face of the case in the second direction.

5. The ink cartridge of claim 4, wherein the ink supply portion extends from the front face of the case in the second direction, and the at one portion of the movable member extends further from the front face of the case in the second direction than the ink supply portion extends from the front face of the case in the second direction.

6. The ink cartridge of claim 1, further comprising:

a translucent portion positioned at the front face of the case and extending away from the ink chamber, wherein the translucent portion has an inner space formed therein, and the inner space is configured to be in fluid communication with the ink chamber;

a further movable member positioned within the inner space, wherein the further movable member is configured to move within the inner space based on an amount of ink in the ink chamber.

7. The ink cartridge of claim 6, wherein the at least one portion of the movable member extends adjacent to and away from the front face of the case in the second direction.

8. The ink cartridge of claim 7, wherein each of the ink supply portion and the translucent portion extends from the front face of the case in the second direction, and the at least one portion of the movable member extends further from the front face of the case in the second direction than each of the ink supply portion and the translucent portion extends from the front face of the case in the second direction.

9. The ink cartridge of claim 1, wherein the case further comprises a particular face connected to each of the front face and the rear face, and the movable member comprises a first portion and a second portion extending from the first portion in the second direction, wherein the at least one resilient member is coupled to the first portion of the movable member, and the second portion of the movable member engages the particular face and extends away from the front face in the second direction.

10. The ink cartridge of claim 9, wherein the ink supply portion extends from the front face of the case in the second direction, and the second portion of the movable member extends further from the front face of the case in the second direction than the ink supply portion extends from the front face of the case in the second direction.

11. The ink cartridge of claim 10, further comprising:

a translucent portion positioned at the front face of the case and extending away from the ink chamber, wherein the translucent portion has an inner space formed therein, and the inner space is configured to be in fluid communication with the ink chamber;

a further movable member positioned within the inner space, wherein the further movable member is configured to move within the inner space based on an amount of ink in the ink chamber, wherein each of the ink supply portion and the translucent portion extends from the front face of the case in the second direction, and the second portion of the movable member extends further from the front face of the case in the second direction than each of the ink supply portion and the translucent portion extends from the front face of the case in the second direction.

12. The ink cartridge of claim 1, wherein the case further comprises a particular face connected to each of the front face and the rear face, and a further face opposite the particular face and connected to each of the front face and the rear face, wherein the movable member comprises a first portion, a second portion extending from the first portion in the second direction, and a third portion extending from the first portion in the second direction, wherein the at least one resilient member is coupled to the first portion of the movable member, the second portion of the movable member engages the particular face and extends away from the front face in the second direction, and the third portion of the movable member engages the further face and extends away from the front face in the second direction.

13. The ink cartridge of claim 12, wherein the ink supply portion extends from the front face of the case in the second direction, and each of the second portion and the third portion of the movable member extends further from the front face of the case in the second direction than the ink supply portion extends from the front face of the case in the second direction.

14. The ink cartridge of claim 13, further comprising:

a translucent portion positioned at the front face of the case and extending away from the ink chamber, wherein the translucent portion has an inner space formed therein, and the inner space is configured to be in fluid communication with the ink chamber;

a further movable member positioned within the inner space, wherein the further movable member is configured to move within the inner space based on an amount of ink in the ink chamber, wherein each of the ink supply portion and the translucent portion extends from the front face of the case in the second direction, and each of the second portion and the third portion of the movable member extends further from the front face of the case in the second direction than each of the ink supply portion and the translucent portion extends from the front face of the case in the second direction.

15. The ink cartridge of claim 1, wherein the movable member is positioned outside of the case.

16. An ink cartridge, comprising:

a case having at least a portion of an ink chamber defined therein, wherein the ink chamber is configured to store ink, and the case has a front face and a rear face opposite the front face;

an ink supply portion positioned at the front face of the case, wherein the ink supply portion is configured to dispense ink from an interior of the ink chamber to an exterior of the ink chamber;

a movable member positioned outside of the case and configured to move relative to the case; and at least one resilient member having a first end which is coupled to the rear face of the case and a second end which is coupled to the movable member, wherein the at least one resilient member is configured to expand in an expansion direction and to contract in a contraction direction opposite the expansion direction to move the movable member relative to the case, and a size of the case in the expansion and contraction directions is unaltered when the at least one resilient member expands and contracts, wherein the entire moveable member is configured to substantially simultaneously move in a first direction relative to the case when the at least one resilient member expands, and the entire moveable member is configured to substantially simultaneously move in a second direction opposite the first direction when the at least one resilient member contracts.

* * * * *